United States Patent [19]

Olsen

[11] 4,029,440

[45] June 14, 1977

[54] HIGH PRESSURE FLUID INTENSIFIER AND METHOD

[75] Inventor: John H. Olsen, Vashon, Wash.

[73] Assignee: Flow Industries, Inc., Kent, Wash.

[22] Filed: Mar. 16, 1976

[21] Appl. No.: 667,380

Related U.S. Application Data

[63] Continuation-in-part of Ser. No. 606,733, Aug. 21, 1975, abandoned, which is a continuation of Ser. No. 427,449, Dec. 26, 1973, abandoned, which is a continuation-in-part of Ser. No. 322,956, Jan. 12, 1973, Pat. No. 3,811,795.

[52] U.S. Cl. ..... 417/403; 91/305

[51] Int. Cl.[2] ..... F04B 17/00; F04B 35/00

[58] Field of Search ..... 417/403, 404; 91/305, 91/306, 307; 137/625.69

[56] References Cited

UNITED STATES PATENTS

| | | | |
|---|---|---|---|
| 2,942,584 | 6/1960 | Rethmeier | 91/464 |
| 3,070,023 | 12/1962 | Glasgow | 91/305 |

*Primary Examiner*—Carlton R. Croyle
*Assistant Examiner*—G. P. LaPointe
*Attorney, Agent, or Firm*—Robert B. Hughes

[57] ABSTRACT

A pressure intensifying apparatus to deliver a very high pressure stream of water through a nozzle. There is a single working piston having two pressure surfaces of a relatively large area, the working piston being connected to two high pressure pistons each having a pressure surface of a relatively small area. A control valve delivers a high pressure working fluid alternately to opposite sides of the working piston to cause it to reciprocate so that the pressure pistons alternately deliver water at high pressure to the nozzle. In shifting between its two end positions, the control valve passes through an intermediate position at which a restricted flow passage is provided for the working fluid, this restricted flow passage having an effective cross sectional area relative to the effective area of the largest size discharge nozzle used with the intensifier, such that the back pressure of the restricted passage of the control valve does not substantially exceed the back pressure exerted on the working fluid so that substantial pressure spikes are not imposed on the high pressure source of working fluid. In another configuration, the control valve in its intermediate position is also provided with a restricted flow passage leading from the then pressurized working chamber to the pump low pressure return line, thus alleviating potential pressure surges from the fluid in the pressurized working chamber. Further, in one embodiment there is a valve shifting mechanism comprising two shifting valves, each of which is responsive not only to physical contact by the working piston, but also to pressurization of its related working chamber to cause rapid shifting of the control valve. In another embodiment, there is a valve shifting mechanism comprising a shifting valve operably connected to said working piston through flexible actuating cables and arranged to direct fluid under pressure to opposite sides of the control valve alternately to move the control valve between its two end positions.

16 Claims, 23 Drawing Figures

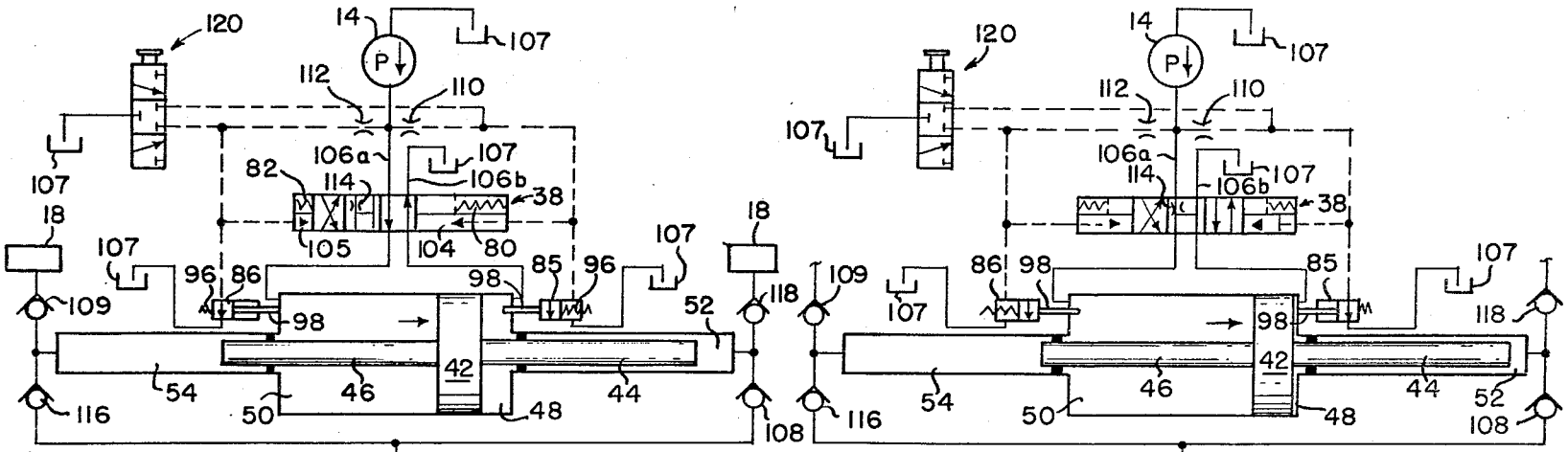
FIG. 5
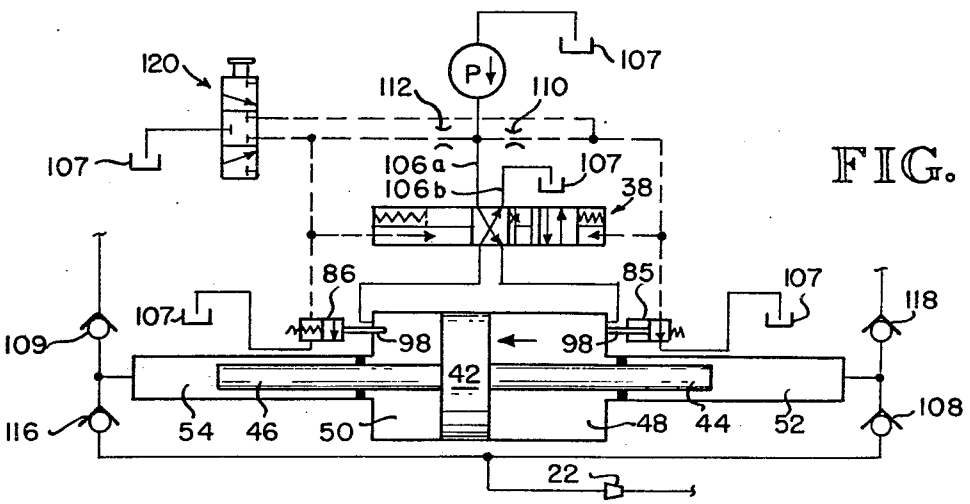
FIG. 6
FIG. 4

FIG. 8
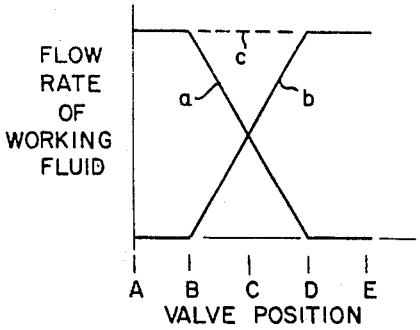
FIG. 9
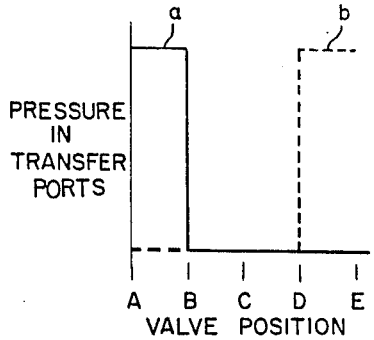
FIG. 10
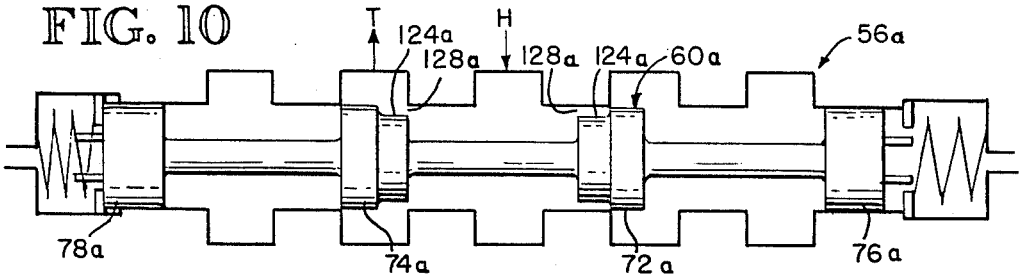
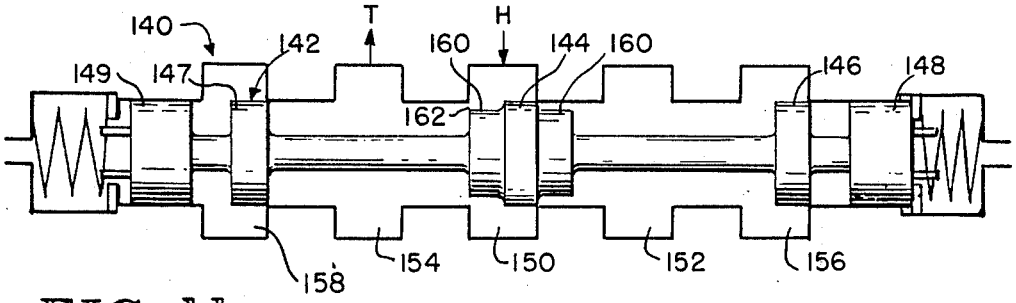
FIG. 11

HIGH PRESSURE FLUID INTENSIFIER AND METHOD

CROSS REFERENCE TO RELATED APPLICATIONS

This is a continuation-in-part application of my pending U.S. patent application, entitled "High Pressure Fluid Intensifier and Method", Ser. No. 606,733, filed Aug. 21, 1975, now abandoned, which is a continuation application of my U.S. patent application of the same title, Ser. No. 427,449, filed Dec. 26, 1973, now abandoned, which is in turn a continuation-in-part application to my U.S. patent application entitled "High Pressure Fluid Intensifier and Method", Ser. No. 322,956, filed Jan. 12, 1973, now U.S. Pat. No. 3,811,795, issued May 21, 1974.

BACKGROUND OF THE INVENTION

1. Field of the Invention

This invention relates to a high pressure fluid intensifier, such as an intensifier arranged to deliver a stream of fluid at very high pressure, to accomplish a function such as cutting, drilling or waterblast cleaning.

2. Description of the Prior Art

There are in the prior art various pressure intensifying systems where a larger working piston is reciprocated to provide a high pressure output by means of smaller high pressure pistons.

However, there are a number of interrelated problems connected with the shifting of the larger working piston at the end limit of travel of each of its strokes. To alleviate the possible interruption of the flow of high pressure output fluid during shifting of the working piston, it is desirable to accomplish this shifting as quickly as possible. One problem in the prior art is that of alleviating pressure surges in the working fluid while the working piston is being reversed. Also, to obtain a rapid reversal of the working piston, it usually requires a correspondingly rapid reversal in the flow of pressurized working fluid, which in turn further aggravates the problem of undesired pressure surges or hydraulic shocks in the system. One means of alleviating this is to provide one or more relatively large hydraulic accumulators to sustain the flow of output fluid during reversal of the working piston, while accomplishing the reversal of the working system at a somewhat slower rate. However, this usually adds considerably to the bulk and cost of the system.

Typical of the prior art devices which show pressure intensifying systems and various valve switching mechanisms adaptable for such systems are the following U.S. Patents: Atkinson, No. 153,296; West et al, No. 2,000,805; Rethmeier, No. 2,942,584; Murray, No. 3,045,611; Pennther, No. 3,540,349; Bowen, No. 3,565,191; McGann, No. 549,739; Maxwell No. 932,992; Bowser, No. 1,199,526, and Swiss Pat. No. 262,891.

It is an object of the present invention to provide a high pressure fluid intensifier having a desirable balance of advantageous features, particularly with respect to the problems and considerations mentioned above.

SUMMARY OF THE INVENTION

In the apparatus of the present invention, there is a piston assembly comprising a working cylinder in which a working piston is mounted for reciprocating motion, the piston dividing the cylinder into first and second working chambers. Two high pressure pistons are connected to the working piston in a manner that reciprocation of the working piston causes a flow of high pressure fluid to be produced alternately from the two high pressure pistons. The high pressure flow is directed through a discharge nozzle to produce a high velocity stream of water. To cause reciprocation of the working piston, there is a control valve having first and second positions to deliver pressurized working fluid to, respectively, the first and second working chambers.

According to one facet of the present invention, the control valve has a third intermediate position through which it passes in moving between its first and second positions. In the intermediate position pressurized working fluid is directed through a pressure reducing flow passage, which produces a back pressure which does not substantially exceed the back pressure resulting from transmitting power through the working piston and the pressure intensifying pistons to produce a high pressure fluid flow through the output nozzle. Thus, during reversal of the working piston when the control valve passes through its intermediate position, any substantial surge of back pressure against the working fluid source is alleviated.

In another configuration, the control valve is so arranged that as it passes through its intermediate position, there is a restricted flow passage from the then pressurized working chamber to cause a controlled reduction of pressure in that working chamber, thus alleviating potential pressure surges from the pressurized fluid in the intensifier.

In accordance with another configuration of the present invention, there is provided a snap action actuating means in the form of a pair of flexible mechanical cables which are engaged by the piston assembly to actuate a shifting valve operatively connected to the control valve. Movement of the shifting valve from one position to the other causes a controlled flow of pressurized fluid through a restricted orifice which moves the control valve at a controlled rate through its intermediate position so that a proper reversal of fluid flow in the system is accomplished.

Other more specific features of the present invention will become apparent from the following detailed description.

BRIEF DESCRIPTION OF THE DRAWINGS

FIGS. 4–6 are semi-schematic drawings illustrating the operating sequence of the first embodiment of the present invention;

FIG. 8 is a graph illustrating the flow characteristics in the control valve in the sequence of operation of FIGS. 7A–7E;

FIG. 9 is a graph illustrating the pressure characteristics of the control valve in the sequence of operation of FIGS. 7A–7E;

FIG. 10 is a semi-schematic illustration of a second modified form of the control valve of the first embodiment;

FIG. 11 is a semi-schematic drawing of a third modified form of the control valve of the first embodiment;

DESCRIPTION OF THE PREFERRED EMBODIMENTS

Figure 1:
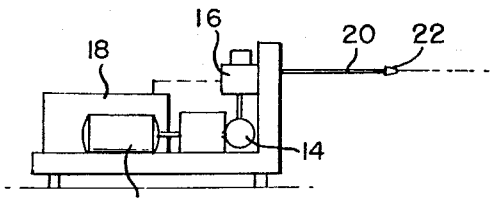
FIG. 1 is a semi-schematic side elevational view of the over all apparatus of the present invention.

With reference to FIG. 1, there is shown an electric motor 10 which drives a hydraulic pump 14, which in turn supplies working fluid to a pressure intensifier unit 16. The intensifier 16 draws fluid (i.e. water) from a suitable source, such as a reservoir 18, and discharges the water at a very high pressure through an output, which as shown herein is a tube 20 with a small area exit nozzle 22. This results in a discharge of a fluid jet stream of a small diameter (e.g. 0.03 inches) and a very high velocity (e.g. 1200 feet per second or greater).

Figure 3:
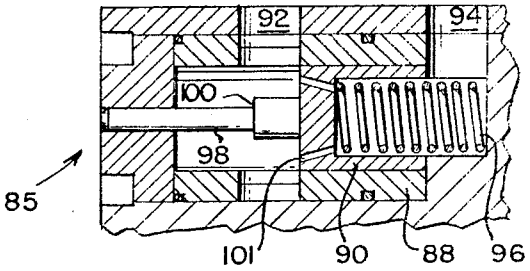
FIG. 3 is a sectional view of one of the shifting valves of the apparatus of FIG. 2.

In describing the present invention in detail, first the physical components of the first embodiment of the pressure intensifying unit 16 will be described with reference to FIGS. 2 and 3. Second the over all operation of the total apparatus of the first embodiment will be described with reference to the sequential schematic drawings of FIGS. 4 through 6. Thereafter, the precise manner in which the control valve 38 functions to accomplish the proper operation of this apparatus will be described in more detail with reference to the sequential illustrations of FIGS. 7A through 7E, and the two graphs of FIGS. 8 and 9, with two modified valves being shown in FIGS. 10 and 11. Finally, the second embodiment of the present invention will be described with reference to FIGS. 12 through 14, with the operation of the control valve of the second embodiment being described more particularly with reference to FIGS. 15A through 15E.

Figure 2:
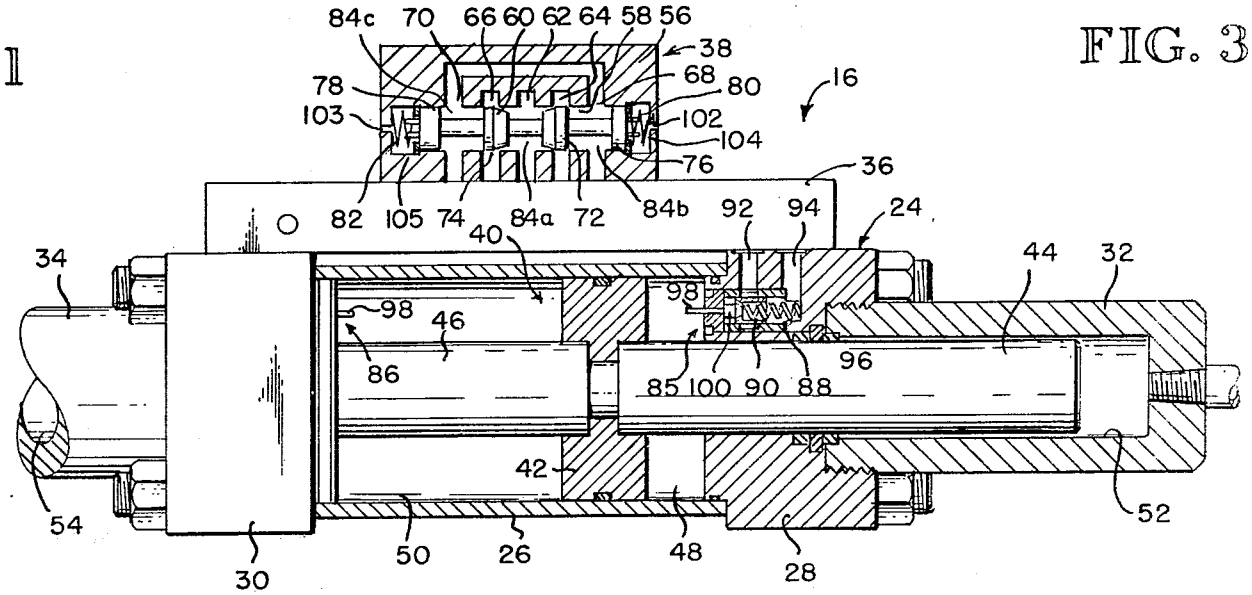
FIG. 2 is a view partly in section of the pressure intensifying apparatus of a first embodiment of the present invention.

The physical components of a first embodiment of the pressure intensifying unit 16 are illustrated in FIG. 2. For clarity of illustration, the various fluid lines and passages built into or attached to the unit 16 are not illustrated in FIG. 2, but rather are shown schematically in FIGS. 4 through 6. With reference to FIG. 2, the pressure intensifying unit 16 comprises a main housing 24, comprising a main cylinder 26, right and left end bell members 28 and 30, respectively, mounted to the ends of the cylinder 26, and right and left high pressure cylinders 32 and 34, respectively, threaded into respective bells 28 and 30. Connected to the housing 24 is a manifold block 36 on which is mounted a flow control valve 38.

Mounted for reciprocating motion within the housing 24 is a unitary piston assembly 40. This assembly comprises a larger diameter central working piston 42 mounted within the main cylinder 26, and right and left high pressure pistons 44 and 46, respectively, extending oppositely from the center working piston 42. The working piston 42 divides the interior of the main cylinder 26 into right and left working chambers 48 and 50 respectively. The high pressure piston 44 reciprocates in the right high pressure chamber 52 defined by the right cylinder 32, while the left high pressure piston 46 reciprocates in the left high pressure chamber 54 defined by the other cylinder 34.

The aforementioned control valve 38 comprises a valve housing 56 defining a transfer chamber 58, in which is slide mounted a valve spool 60. In the housing 56 is a centrally located high pressure fluid inlet port 62, right and left transfer ports 64 and 66, respectively, on opposite sides of the inlet port 62, and right and left low pressure outlet ports 68 and 70, respectively, positioned outside of the two transfer ports 64 and 66.

The valve spool 60 comprises right and left lands or pistons 72 and 74, respectively, and right and left outermost end closure members 76 and 78, respectively. Outside the two closure members 76 and 78 are respective right and left centering springs 80 and 82, respectively, which urge the spool 60 to its center position in the housing 56; each of the springs 80 and 82 has a stop collar 83 engaging a stop shoulder 83*a* to prevent either spring 80 or 82 urging the valve spool 60 beyond its center position.

The center port 62 is connected to a high pressure line from the pump 14, while the ports 68 and 70 are connected to the low pressure return line of the pump 14. The right transfer port 64 connects to the right working chamber 48, and the left transfer port 66 connects to the left working chamber 50. The groove or chamber 84*a* located between the two piston elements 72 and 74 is a high pressure fluid transfer chamber, and functions to direct high pressure fluid from the port 62 to either the right transfer port 64 or the left transfer port 66 when in, respectively, a right or left hand position. The right piston 72 and the right closure piston 76 define a groove or chamber 84*b* which is a low pressure transfer chamber that functions to connect the transfer port 64 with the low pressure outlet port 68 when the spool 60 is in its left hand position. In like manner, the left transfer piston 74 and left closure piston 78 define therebetween a groove or chamber 84*c* which functions to connect the left transfer port 66 with the low pressure outlet port 70 when the spool 60 is in its right hand position.

To move the spool 60 of the valve 38 between its right and left positions, there are two shifting valves 85 and 86, respectively, located in, respectively, the right and left bell sections 28 and 30 of the housing 24. For convenience of illustration only the right shifting valve 85 is shown in section in FIG. 2 (the valve 85 and 86 being substantially identical). Each of the valves 85 and 86 comprises a sleeve 88 in which is slidably mounted a plug 90. There is an inlet port 92 and an outlet or venting port 94, the port 92 being closed from the venting port 94 when the valve is in the closed position shown in FIG. 2. The plug 90 is urged to its closed position by a compression spring 96. To open the valve 85 or 86 there is provided an actuating pin 90 which butts against the plug 90 and extends through the housing to project into the end of its respective working chamber 48 or 50. A locating stop 100 on the pin 98 properly positions the plug 90 in its closing position with the pin 98 extending into the chamber 48 or 50. Through holes 101 in the plug 90 permit flow from the inlet port 92 to the venting port 94 when the plug 90 is pushed by pin 90 against the urging of the spring 96 to its open position shown in FIG. 3. The inlet port 92 of the right shifting valve 85 is connected through an end opening 102 in the housing 56 of the valve 38 to a right control chamber 104 at the right end of the spool 60 of the valve 38, while the inlet port 92 of the left shifting valve 86 is similarly connected to the left control chamber 105 through opening 103 in the left of the valve 38.

In describing the operations of this apparatus, for convenience the over all operation will first be described and then the means for starting the pumping action. In FIG. 4, the valve 38 is in its left hand position, so that high pressure fluid from the high pressure line 106*a* of the pump 14 is directed into the left working chamber 50, while the right working chamber 48 is connected through a low pressure return line 106*b* to the fluid reservoir 107 of the pump 14. This causes the working piston 42 to move to the right, as seen in FIG. 4, which in turn causes the right high pressure piston 44 to force output fluid from the high pressure chamber 52 through a check valve 108 and out the discharge nozzle 22. At the same time, output fluid is being drawn from the source 18 through a check valve 109 into the left high pressure chamber 54.

The pumping pressure of the pump 14 is sufficiently large, relative to the force of the return springs 96 and the cross sectional area of the actuating pins 98 of the shifting valves 85 and 86, that when one of the working chambers 48 or 50 is pressurized by the pump 14, the resulting pressure on its related actuating pin 98 is sufficient to force the pin 98 against the urging of its related spring 96 to open the valve 85 or 86. A portion of the high pressure working fluid is directed from the pump 14 to the valve control chambers 104 and 105 through respective restricted flow orifices 110 and 112, and also to the high pressure inlet ports 92 of the shifting valves 85 and 86. The venting port 94 of each shifting valve 85 or 86 is connected to the pump reservoir 107. Thus, when one of the valves 85 or 86 is closed, its related valve control chamber 104 or 105, respectively, is pressurized, but when one of the valves 85 or 86 is open, its respective valve control chamber 104 or 105 is depressurized.

With reference to FIG. 4, since the working chamber 50 is pressurized from the pump 14, the shifting valve 86 is open so that the left valve control chamber 105 is depressurized. Since the working chamber 48 is connected to the low pressure reservoir 107, the actuating pin 98 protrudes into the chamber 48, so that the shifting valve 85 is closed, with the right valve control chamber 104 being pressurized. The difference in pressure in the two valve control chambers 104 and 105 holds the spool element 60 of the valve 38 in its left hand position against the urging of the spring 82 as seen in FIG. 4.

As the working piston 42 continues to move to the right, it approaches its end limit of travel as shown in FIG. 5. Near its end limit of travel, the piston 42 engages the actuating pin 98 to push the pin 98 and the plug 90 of the shifting valve 85 to its open position to depressurize the right valve control chamber 104. With both the control chambers 104 and 105 depressurized, the left centering spring 82 pushes the spool element 60 toward its center position, as shown in FIG. 5.

When the spool element 60 reaches its center position, two things occur. First, both of the working chambers 48 and 50 become connected to the low pressure pump reservoir 107 through the low pressure return line 106*b* so as to be depressurized. Second, the high pressure supply line 106*a* from the pump 14 becomes connected through a restricted flow passage, indicated schematically at 114, to permit limited flow from the pump 14 back to the pump reservoir 107. The particular manner in which this is accomplished and how this alleviates pressure surges in the high pressure supply line will be described later herein in a more detailed description of the functioning of the valve 38.

The immediate effect of depressurizing both of the working chambers 48 and 50 is to permit the spring 96 to move the left shifting valve 86 outwardly toward the left working chamber 50 to close the left shifting valve 86 and thus cause immediate pressurization of the left valve control chamber 105. This immediately causes the spool element 60 to continue movement through its center or intermediate position to its right position, shown in FIG. 6, where high pressure working fluid is delivered to the working chamber 48, with the left working chamber 50 being connected to the low pressure line 106*b* leading to the pump reservoir 107.

With the right working chamber 48 now pressurized, the working piston 42 moves to the left so that the left high pressure piston 46 forces output fluid from the left high pressure chamber 54 through a check valve 116 and out the output nozzle 22. At the same time, additional output fluid is being drawn into the right high pressure chamber 52 through a check valve 118. With the right working chamber 48 pressurized, as the working piston 42 moves away from physical engagement with the right actuating pin 98, the pressure of the working fluid in the chamber 48 keeps the right actuating pin 98 in its retracted position to maintain the right shifting valve 85 in its open position and maintain the depressurization of the right valve control chamber 104 so that the spool element 60 remains in its right position, as shown in FIG. 6 because of the pressurization of the left valve control chamber 105 due to the left shifting valve 86 being closed.

When the working piston 42 moves toward its left end position to engage the left actuating pin 98, a similar shifting sequence occurs, as described with reference to FIG. 5, to reverse the fluid flow in the working chambers 48 and 50 and cause the working piston 42 to begin movement back to the right.

To initiate operation of the apparatus, there is provided a starting valve, this being shown schematically at 120. The valve 120 has an up position where the right valve control chamber 104 is directly connected to the reservoir 107, a down position where the left valve control chamber 105 is connected to the reservoir 107, and an intermediate position where the valve 120 provides no operative connection to the chambers 104 and 105. In the three illustrations of FIGS. 4 through 6, the starting valve 120 is shown in its center position where it has no effect on the operation of the apparatus. To describe the operation of the starting valve 120, let it be assumed that the pump 14 has been turned off and the entire system has become depressurized, with the spool element 60 of the valve 38 returning to its center position by action of the centering springs 80 and 82. Further, let it be assumed that the working piston 42 is in some intermediate position, as shown in FIG. 4.

When the pump 14 is started, with the valve spool element 60 in its center position, neither of the working chambers 48 or 50 becomes pressurized. However, both of the valve control chambers 104 and 105 are pressurized, since both of the shifting valves 85 and 86 remain closed. These circumstances contribute to the safety of the operation in that the intensifying unit 16 will not inadvertently start pumping when the hydraulic pump is started, provided that piston 42 is not at that moment holding either valve 85 or 86 open. It should be noted that when the motor 10 is turned off to stop the pumping action, there is a gradual decline of hydraulic pressure due to the inertia of the motor and pump. If the motor is turned off and the hydraulic pressure has declined below the level required to hold pin 98 in against spring 96 while the working piston 42 is in contact with one of the pins 98 of one or the other of the shifting valves 85 or 86, this will cause the control valve 38 to remain in either its right or left position to pressurize the working chamber 48 or 50 at which the piston 42 is depressing the pin 98. This in turn causes the piston 42 to move out of engagement with that pin 98 allowing the valve 85 or 86 to close and cause the control valve 38 to return to its center position where neither of the working chambers 48 and 50 is pressurized. Thus, piston 42 will stop in a position remote from pins 98, and when the motor 10 is restarted, the pumping action will not start. By pushing the valve 120 to its down position, the left control chamber 105 becomes exposed to the low pressure pump reservoir 107 so that the high pressure in the right valve control chamber 104 causes the valve element 60 to move to the left (i.e. the position shown in FIG. 4), to cause the piston 42 to move to the right. As soon as the working piston 42 reaches its full right position to engage the right actuating pin 98, the normal shifting sequence goes into effect as described above herein. By moving the starting valve 120 to its up position to cause the spool element 60 to move to the right, the working piston 42 can be caused to move to the left. So if there is some reason that the normal shifting sequence of the apparatus does not function as described above, for example by reason of excess air in the high pressure lines, then the manual starting valve 120 can be used to move the working piston 42 back and forth to clear the hydralic lines so that the normal shifting sequence becomes operative, with the working piston 42 then reciprocating with automatic shifting of the valve 38 as described above.

In the event that there is a break in one of the high pressure output lines to the nozzle 22, there will be an immediate drop in pressure in the output chamber 52 or 54 that is at the time pressurized, and a corresponding drop in pressure in the related working chamber 48 or 50, which happens to be pressurized at that particular instant. When there is such a pressure drop in the pressurized working chamber 48 or 50, its related actuating pin 98 is moved outwardly by spring 96 to its valve closing position to close its related shifting valve 85 or 86 to pressurize its related valve control chamber 104 and 105 (both chambers 104 and 105 then being pressurized) so that the valve element 60 returns to its center position by action of the centering springs 80 and 82 to vent both working chambers 48 and 50 to low pressure and halt movement of the working piston 42. Thus, in the event of any break in the high pressure lines, the system immediately shuts itself off.

To describe in more detail the operation of the control valve 38, reference is now made to FIGS. 7A through 7E.

Figure 7A:
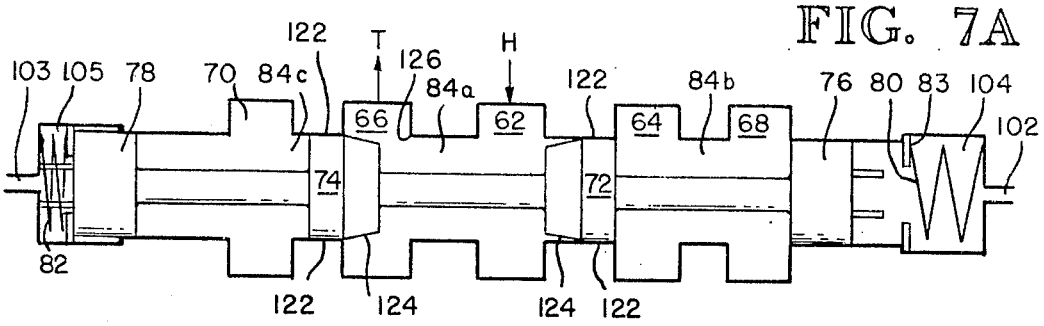
FIGS. 7A–7E are a series of semi-schematic drawings showing the sequence of operation of the control valve of the first embodiment.

In FIG. 7A, the spool element 60 is shown in its full left position (shown schematically in FIG. 4), where the right piston 72 is positioned between the high pressure port 62 and the right transfer port 64 so as to block any flow therebetween, while the left piston 74 is positioned so as to block any flow from the left transfer port 66 into the low pressure outlet port 70. In this position, there is free flow from the high pressure port 62 to the left transfer port 66 through the center high pressure chamber **84*a* to pressurize the working chamber 50 as described above. Also, the right transfer port 64 communicates with the low pressure port 68 through the right low pressure transfer chamber 84*b* so that the right working chamber 48 is depressurized. As described above, the spool element 60 remains in this position until working piston 42 reaches its extreme right end of travel to cause shifting of the valve spool element 60** to the right.

Figure 7B:
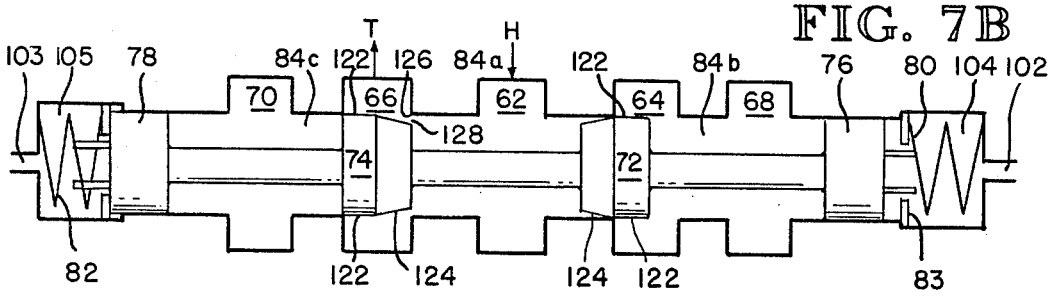

In FIG. 7B, the valve element 60 is shown moving from its extreme left hand position through a position where it is just about to enter its intermediate position. It will be noted that the laterally outermost position 122 of the circumferential surfaces of each of the pistons 72 and 74 is substantially cylindrical so that it fits against the inner cylindrical surface of the housing 56. However, the laterally inward circumferential surface portion 124 of each of the pistons 72 and 74 (i.e. those surface portions closer to the center of the spool element 60) are tapered very moderately inwardly toward the middle of the spool element 60. For purposes of illustration, this taper is shown to be at a somewhat larger angle than normally used, this taper ordinarily being in the order of one degree from the longitudinal axis of the spool element 60. It can be seen that in the position shown in FIG. 7B the tapered surface 124 of the left piston 74 forms with the inner edge 126 of the left transfer port 66 a restricted circumferential flow passage 128.

Figure 7C:
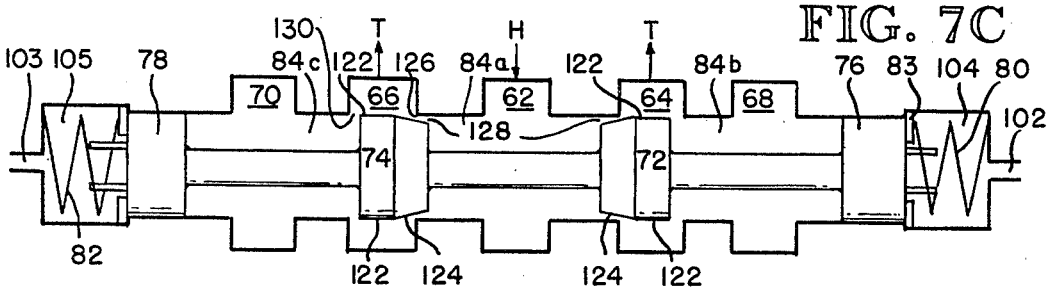
Figure 7D:
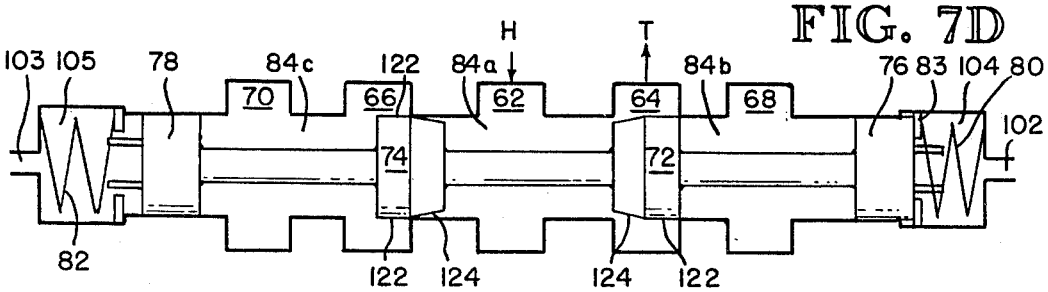

As the piston continues to move from the position of FIG. 7B toward the position of FIG. 7C, where the spool element 60 is centered, a passage opens at 130 from the left transfer port 66 through the left low pressure transfer chamber 84c to the low pressure outlet port 70. Because of the very shallow taper of the surface 124, as soon as the spool element 60 moves a very short distance from the position of FIG. 7B, the passageway 130 has a much larger cross sectional area than the passage of 128, so that there is a large pressure drop from the inlet port 62 across the passageway 128, and the pressure in the transfer port 66 almost immediately drops to the pump reservoir pressure that exists in the outlet port 70. As the spool 60 continues to move to the right from position 7B to that of 7C, the left flow passage 128 becomes more restricted, while the right flow passage 128 defined by the piston 72 with the housing 56 becomes less restricted. Since the tapered surfaces 124 are both uniform, the rate of decrease of the cross section of the left restricted passage 128 is substantially the same as the rate of increase of the cross sectional area of the right restricted flow passage 128, so that the total flow rate through both passages 128 is constant. This is illustrated in the graph of FIG. 8, where the flow through the left restricted flow passage 128 is indicated at *a* and the right restricted flow passage 128 is indicated at *b*, with the combined flow through both passages 128 being shown by the dotted line at *c*.

Figure 7E:
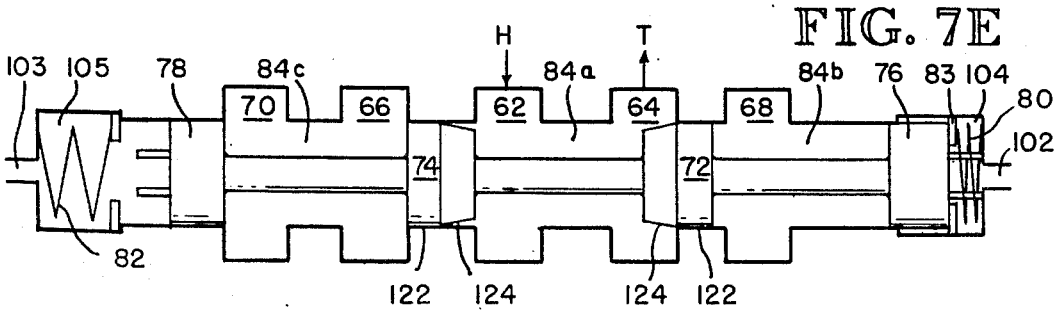

In the graph of FIG. 9, the pressure in the left transfer port 66 is indicated at *a*, while the pressure in the right transfer port 64 is indicated at *b*, in the travel of the spool element 60 from the position of FIG. 7A to that of FIG. 7E.

When the spool element 60 is traveling through its intermediate position (i.e. from the position of FIG. 7B, through the position of FIG. 7C to the position of FIG. 7D), both the right and left transfer ports 64 and 66 are at the low pump reservoir pressure since the flow passages 130 have a substantially larger cross sectional flow area than the passages 128 (in the order of perhaps one hundred times as great when the spool element 60 is in the position of FIG. 7C).

As described previously herein, as soon as the pressurized working chamber 48 or 50 becomes depressurized, there is an immediate pressure imbalance in the two valve control chambers 104 and 105, which causes the spool element 60 to continue movement through its center position to its other end position. When the spool element reaches the position shown in FIG. 7D, the spool element 60 is now moving from its intermediate position to its right position. At this point, the left restricted flow passage 128 is being completely closed off, while the right restricted flow passage 128 has reached its maximum effective cross sectional flow area. Simultaneously, the flow path from the right transfer port 64 into the right low pressure outlet port 68 is being abruptly closed off by the right piston 72 so that there is an abrupt rise in the transfer port 64 from pump reservoir pressure to high pressure. As the spool element 60 continues movement to the right to the extreme right position of FIG. 7E, there is substantially unrestricted flow from the high pressure port 62 to the transfer port 64 to cause pressurization of the right working chamber 48.

It is important to note that the total cross sectional area of the two restricted flow passages 128 remains substantially constant as the spool element 60 is moving through its intermediate phase from the position of FIG. 7B to that of 7D. These two restricted flow passages 128 are, in effect, the same restricted flow passages indicated at 114 in the schematic drawings of FIGS. 4–6. The effective combined cross sectional area of the two flow passages 128 is so dimensioned that the back pressure exerted at the passages 128 does not substantially exceed the pressure existing in either of the working chambers 48 and 50 when pressurized with the control valve 38 in either its right or left position. The effect of this is that when the valve element 60 is moving from its right position through its intermediate position to its left position or vice versa, the back pressure exerted on the high pressure line from the pump 14 does not experience any upward pressure surges.

The pressure relationship is accomplished by properly selecting the effective total cross sectional area of the passages 128 relative to the effective cross sectional flow area of the largest output nozzle 22 used with the apparatus and also relative to the effective pressure areas of the working piston 42 and the high pressure pistons 44 and 46, and to the frictional forces acting on the piston assembly. To explain this relationship let us first assume these frictional forces are negligable and represent only a small correction to the relationship. It should be point out that the ratio of the pressure in either of the high pressure chambers 52 or 54 to the pressure in the working chamber 50 is inversely proportional to the area of the piston 44 (which is the square of the radius of the piston 44 time $\pi$ ) and proportional to the working area of the low pressure piston 42 (which is the square of the radius of the piston 42 times $\pi$ minus the cross sectional area of the piston 44). The pressure drop through the output nozzle 22 is proportional to the square of the average velocity of fluid flow from the nozzle 22 times the density of the output fluid (i.e. water). Likewise, the pressure drop across the flow passages 128 is proportional to the square of the average flow velocity of the fluid through the passages 128 times the density of the working fluid from the pump 14. Thus, the effective cross sectional flow area of the passages 128, or of the passage shown schematically at 114, should be proportional to the effective cross sectional flow area of the nozzle 22 times the working area of the low pressure piston 42, divided by the pressure area of either of the pressure pistons 44 or 46, multiplied by the square root of the ratio of the pressure area of the working piston 42 to the pressure area of the high pressure piston 44 and 46, multiplied by the square root of the ratio of the density of the working fluid to the density of the output fluid. Expressed mathematically, this relationship can be stated as follows:

$$C_v A_v = \frac{C_n A_n A_w}{A_p}\left(\sqrt{\frac{A_w}{A_p}}\right)\sqrt{\frac{D_w}{D_o}}$$

$A_W$= the effective pressure area of the working piston 42

$A_P$= the effective pressure area of the pressure piston 44 or 46

$A_n$= the effective cross sectional flow area of the largest nozzle 22 to be used in the apparatus $A_v$= the effective flow area of the restricted flow passages 128 of the control valve $C_n$= orifice discharge coefficient of nozzle $C_v$= orifice discharge coefficient of restricted flow passages 128 of the control valve $D_w$= the density of the working fluid $D_o$= the density of the output fluid To give a numerical example, let it be assumed that the densities of the working fluid and output fluid are approximately equal, that the discharge coefficients are equal, and that the effective working area of the piston 42 is approximately four times the working area of either of the pressure pistons 44 or 46. The total flow of working fluid into either of the low pressure chambers 48 or 50 would be four times the flow from either of the high pressure chambers 52 and 54. According to the above formula, the total effective cross sectional flow area of the restricted valve passageway (either the passages 128 or the schematic passage 114), should be eight times the effective cross sectional flow area of the nozzle 22. In practice the passages 128 would be chosen slightly smaller to correct for the additional pressure required for overcoming friction. As will be described more fully with regard to the second embodiment described herein, after this relationship is established, if smaller nozzles are then used for lower power applications, the operation of the apparatus is not adversely affected to any significant extent.

In FIG. 10, there is shown a second modified form of the control valve of the first embodiment of the present invention, in which components corresponding to the valve 38 of the first valve will be given like numerical designations, with an *a*suffix distinguishing those of the second form. Thus there is a housing **56*a* in which is mounted a valve spool 60*a*, comprising right and left pistons 72*a* and 74*a*, respectively, and right and left outermost end closure members 76*a* and 78*a*. However, instead of forming the inner circumferential surface portions of the pistons 72***a* and 74*a* with a tapered surface, these surface portions of the piston element 72*a* and 74*a* are stepped radially inwardly as at 124*a*. Thus, when the valve element 60*a* passes through its intermediate position (corresponding to the movement of the valve element of the first embodiment as it moves from the position of FIGS. 7B to the position of FIG. 7D), there are two restricted flow passages 128*a*, through which there are substantially equal flows. As in the first valve, the combined effective cross sectional flow area of the two passages of 128*a* is such as to not substantially exceed the back pressure exerted from the output nozzle back through the system to the pressurized working fluid.

A third configuration of the control valve of the first embodiment is illustrated in FIG. 11. In this third valve, there is a housing 140 in which there is a movable valve element 142 comprising a center piston 144 and two side pistons 146 and 147, respectively, and two end closure pistons 148 and 149, respectively. There is a center high pressure inlet port 150, right and left transfer ports 152 and 154, respectively, on opposite sides of the port 150, and right and left low pressure ports 156 and 158, respectively, located outside the ports 152 and 154.

These components are arranged so that when the valve element 142 is in the right hand position, the right transfer port 152 communicates with the low pressure port 156 to permit outflow of working fluid from its related working chamber, while high pressure fluid is being directed from the port 150 through the transfer port 154 to pressurize the other working chamber. With the valve element 142 in its left hand position, the opposite situation occurs, with high pressure fluid being directed into the port 152 and the port 154 being connected to low pressure.

The circumferential surface of the center piston 144 is stepped radially inwardly at 160 at both of its circumferential portions laterally outward from the middle of the center piston 144. These two stepped surfaces 160 form with the housing 140 restricted flow passages 162 which perform substantially the same function as the aforementioned flow passages 128 and 128*a* of the first and second valves. For this reason, no detailed description will be provided of the operation of this third valve configuration, since it is apparent from the description of the operation of the prior two configurations of the control valve.

Figure 13:
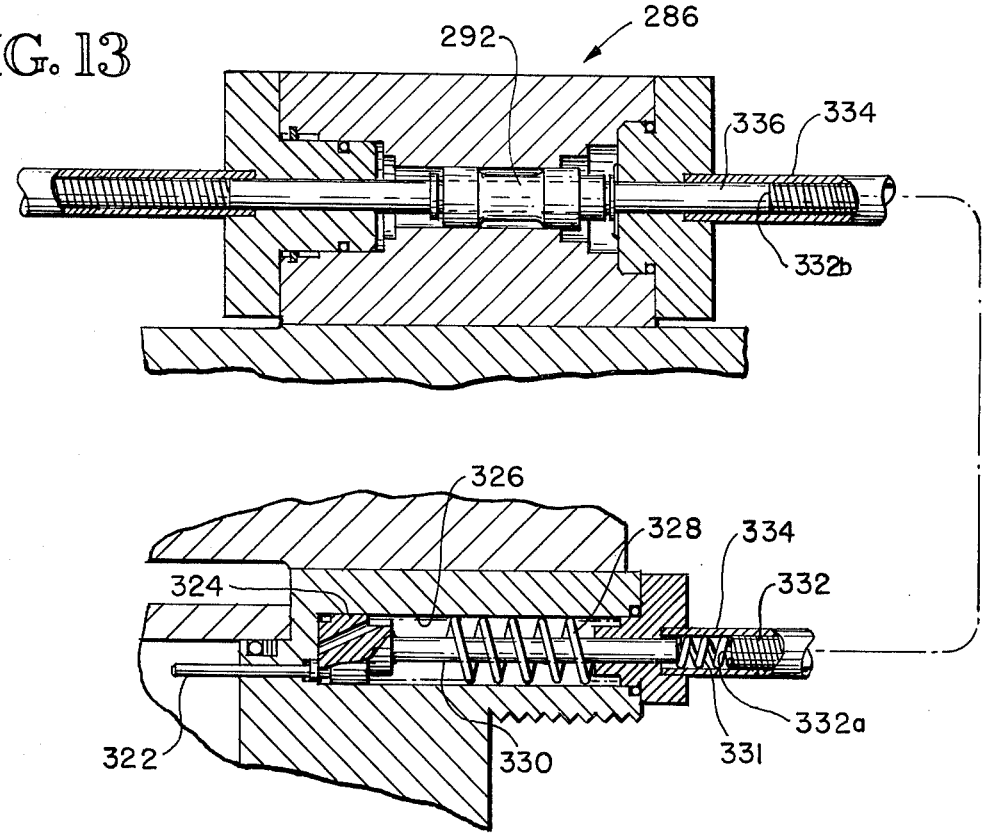
FIG. 13 is a two-part sectional view illustrating the shifting valve of the second embodiment and one side of the shifting valve actuating mechanism.
Figure 14:
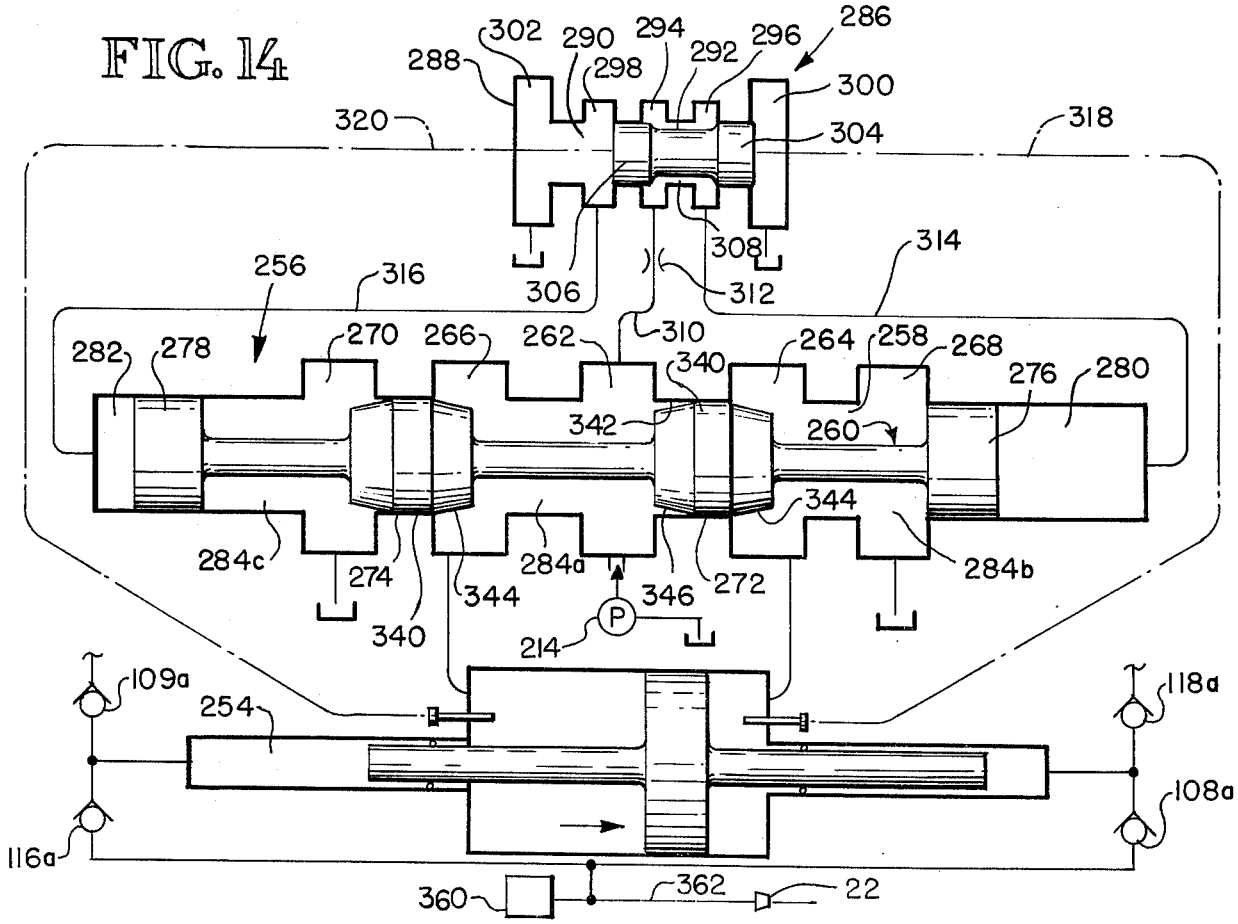
FIG. 14 is a semi-schematic view illustrating the control valve of the second embodiment of the present invention.

The second embodiment of the present invention will now be described with respect to FIGS. 12–14, after which the operation of the control valve of this second embodiment will be described more particularly with reference to FIGS. 15A–15E.

Figure 12:
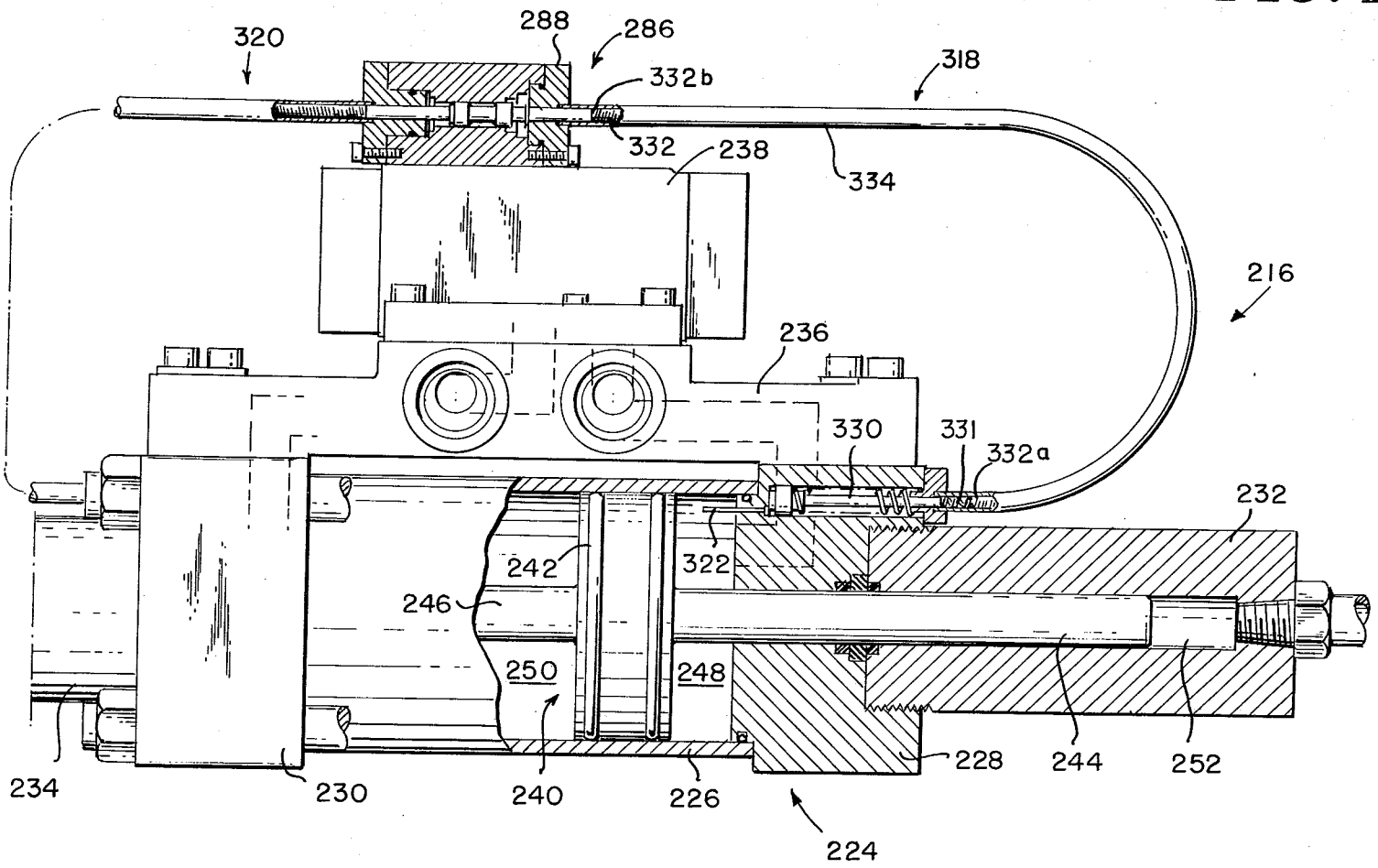
FIG. 12 is a view partly in section, of a second embodiment of the present invention.

In FIG. 12, there is shown a pressure intensifying unit 216. For clarity of illustration, the various fluid lines and passages built into or attached to the unit 216 are not illustrated in FIG. 12, but rather are shown schematically in FIG. 14. With reference to FIG. 12, the pressure intensifying unit 216 comprises a main housing 224 comprising a main cylinder 226, right and left end bell members 228 and 230, respectively, mounted to the ends of the cylinder 226, and right and left high pressure cylinders 232 and 234, respectively, threaded into respective bells 228 and 230. Connected to the housing 224 is a manifold block 236 on which is mounted a flow contol valve 238.

Mounted for reciprocating motion within the housing 224 is a unitary piston assembly 240. This assembly comprises a larger diameter central working piston 242 mounted within the main cylinder 226, and right and left high pressure pistons 244 and 246, respectively, extending oppositely from the center working piston 242. The working piston 242 divides the interior of the main cylinder 226 into right and left working chambers 248 and 250, respectively. The high pressure piston 244 reciprocates in a right high pressure chamber 252 defined by the right cylinder 232, while the left high pressure piston 246 reciprocates in the left high pressure chamber 254 defined by the other cylinder 234.

The aforementioned control valve 238 comprises a valve housing 256 defining a transfer chamber 258, in which is slide mounted a valve spool 260. In the housing 256 is a centrally located high pressure fluid inlet port 262, right and left transfer ports 264 and 266, respectively, on opposite sides of the inlet port 262, and right and left low pressure outlet ports 268 and 270, respectively, positioned outside of the outside of the two transfer ports 264 and 266.

The valve spool 260 comprises right and left lands or pistons 272 and 274, respectively, and right and left outermost end closure members 276 and 278, respectively. Outside the two closure members 276 and 278 are respective right and left control chambers 280 and 282, respectively, which are alternately pressurized to move the spool 260 between its two end positions in the housing 156.

The center port 262 is connected to a high pressure line from the pump 214, while the ports 268 and 270 are connected to the low pressure return line of the pump 214. The right transfer port 264 connects to the right working chamber 248, and the left transfer port 266 connects to the left working chamber 250. The groove or chamber 284*a* located between the two piston elements 272 and 274 is a high pressure fluid transfer chamber, and functions to direct high pressure fluid from the port 262 to either the right transfer port 264 or the left transfer port 266 when in, respectively, a right or left hand position. The right piston 272 and the right closure piston 276 define a groove or chamber 284*b* which is a low pressure transfer chamber that functions to connect the transfer port 264 with the low pressure outlet port 268 when the spool 260 is in its left hand position. In like manner, the left piston 274 and the left closure piston 278 define therebetween a groove or chamber 284*c* which functions to connect the left transfer port 266 with the low pressure outlet port 270 when the spool 260 is in its right hand position.

To move the spool 260 of the valve 238 between its right and left positions, there is provided a shifting valve 286. This shifting valve 286 comprises a housing 288 mounted to the aforementioned housing 256 of the valve 238. The housing 228 defines a transfer chamber 290, in which is slide mounted a spool 292. The shifting valve 286 is, in and of itself, of a conventional configuration, so it will only be described briefly herein.

In the valve housing 288, there is a central high pressure port 294, right and left transfer ports 296 and 298, respectively, and right and left outermost low pressure transfer ports 300 and 302, respectively. The spool comprises right and left lands or pistons 304 and 306, respectively, with the spool providing a single transfer chamber 308 positioned between the two pistons 304 and 306.

To supply high pressure fluid to the high pressure port 294, there is a line 310 leading from the high pressure port 262 of the control valve 238 through a restricted flow orifice 312 to the chamber 294. The right transfer port 296 connects through a line 314 to the right control chamber 280 of the valve 238, while the left transfer port 298 connects through a second line 316 to the left control chamber 282 of the control valve 238. When the valve spool 296 is in its right hand position, as shown in FIG. 14, high pressure fluid is directed into the right hand control chamber 280 to move the spool 260 of the control valve 238 to its left hand position as shown in FIG. 14. When the spool 296 is moved to its left hand position, the high pressure port 294 communicates with the transfer port 298 to direct high pressure fluid through the line 316 to the left control chamber 282 to move the spool 260 of the control valve 238 to its right hand position. By properly selecting the size of the orifice 312 relative to the pressure of the high pressure fluid, the rate of travel of the spool 260 of the valve 238 can be determined so that the shifting action of the unit 216 is properly accomplished in a controlled manner.

To move the spool 292 of the shifting valve 286 between its right and left hand positions, there are provided right and left shifting valve actuators 318 and 320, respectively, which are substantially identical with each other. The components of the right actuator 318 are shown in detail in FIG. 13. Each actuator 318 comprises a first finger 322 which projects from a related bell housing 228 or 230 a short distance in a longitudinal direction into a related working chamber 248 or 250. The finger 322 is urged into its extended position where it reaches into respective chamber 248 or 250 by means of a related plunger 324 positioned in a recess 326 in its related bell housing 228 or 230, and urged by a spring 328 toward its related finger 322. The plunger 324 has a stem 230 extending rearwardly therefrom, and this stem 330 engages a compression spring 331, which in turn engages one end **332*a* of a flexible cable 332 mounted in a sheathing 334. Such flexible cables 332** are well known in the prior art, and are characterized in that they can be deflected or curved laterally to a moderate extent, but are substantially non-compressible along the length.

The other end of the sheathing 334 of the flexible cable 332 is connected to a related end of the housing 228 of the shifting valve 286. Mounted in the end portion of the housing 288 and extending into that end of the sheathing is an actuating finger 336 which extends through its related end of the valve housing 288 and engages a related end of the valve spool 292. The other end of the actuating finger 336 engages the adjacent end **332*b* of the flexible cables 332**.

In operation, when the working piston 242 reaches its end limit of travel, it engages the proximate pin 322, which in turn pushes the plunger 324 against the spring 331 which in turn presses against the cable 332. As the working piston 242 pushes the finger 32 further inwardly, the spring 331 becomes compressed further, to increase the force with which it presses against the cable 332. There is an opposite resisting force against the spring 331 in the form of the frictional force created by each of the cables 332 in its associated sheathing 334 of the actuators 318 and 320. However, when the spring 331 of the actuator 318 reaches a force level which is sufficient to overcome this frictional force, there is a "snap action" of the actuating finger 336 moving the valve spool 292 to its opposite position and moving the opposite cable 332 in its sheath away from the spool 292.

As described previously, when the spool 292 is shifted from one position to the other, the pressure in the two control chambers 280 and 282 is reversed, which causes the spool 260 of the control valve 238 to move to its opposite position. This in turn shifts the flow to the working chambers 248 and 250 so that the working piston 242 at its end limit of travel begins to travel in the opposite direction.

Of particular significance in this embodiment of the present invention is the control valve 238. It will be noted that the two pistons 272 and 274 each have a middle cylindrical surface portion 340 which fits closely against the inner cylindrical surface 342 that defines the valve chamber 258. Also, each piston 272 and 274 has, an in the valve configuration of the first embodiment, an inwardly directed, radially tapered surface 344. In addition, each of the pistons 272 and 274 has an outwardly directed tapered surface 346. Thus, in over all configuration, each piston 272 and 274 has a central cylindrical surface 340 which forms a seal with the valve surface 322, and two frusto conical surfaces 344 and 346 positioned on opposite sides of the middle surface 340 and tapering at a moderate angle radially inwardly toward the center axis of the spool 260.

Figure 15A:
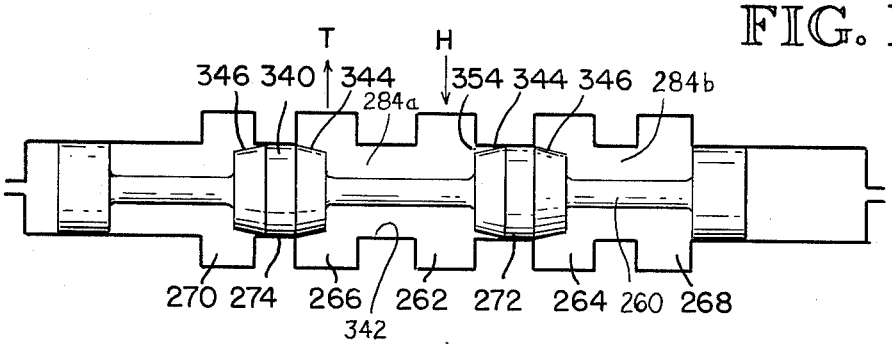
FIGS. 15A–15E are a series of semi-schematic drawings showing the sequence of operation of the control valve of the second embodiment.

To describe in more detail the operation of the control valve 238, reference is now made to FIGS. 15A through 15E. In FIG. 15A, the spool element 260 is shown in its full left position, where the right piston 272 is positioned between the high pressure port 262 and the right transfer port 264 so as to block any flow therebetween, while the left pistom 274 is positioned so as to block any flow from the left transfer port 266 into the low pressure output port 270. In this position, there is free flow from the high pressure port 262 to the left transfer port 266 through the center high pressure chamber **284*a* to pressurize the working chamber 250. Also, the right port 264 communicates with the low pressure port 268 through the right low pressure transfer chamber 284*b* so that the right working chamber 248 is depressurized. As described above, the spool element 260 remains in this position until the working piston 242 reaches its extreme right end of travel to engage the right shifting finger 322 to cause the spool 292 of the shifting valve 286** to move to the left and pressurize the left and pressurize the left control chamber.

Figure 15B:
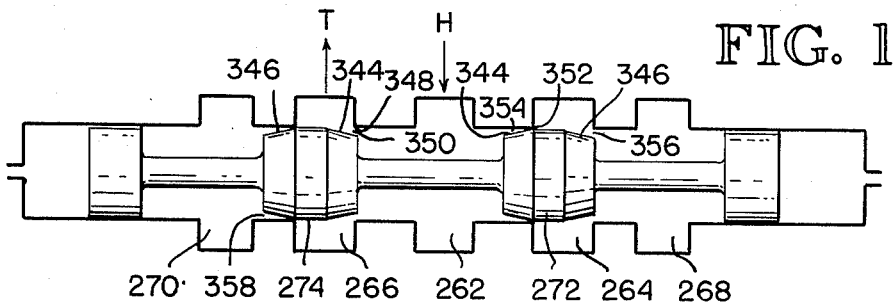

In FIG. 15B, the valve element 260 is shown moving from its extreme left hand position to a position where it is just about to enter its intermediate position. The inner tapered surface 344 of the left piston 274 is just beginning to form with a corner edge portion 348 of the housing 256 a restricted passageway 350, which passageway 350 leads from the high pressure chamber 262 into the left transfer chamber 266. At approximately the same time, the right piston 272 has its inner tapered surface 344 just beginning to move out of engagement with a circumferential edge 352 so as to begin forming a passageway 354. It will also be noted that the outer tapered surface 346 of the right piston 272 is beginning to form another restricted passageway 356 leading from the right transfer port 264 to the right low pressure port 268. A similar passageway 358 is beginning to open between the left transfer port 266 and the right low pressure port 270 along the outer tapered surface 346 of the left piston 274.

Figure 15C:
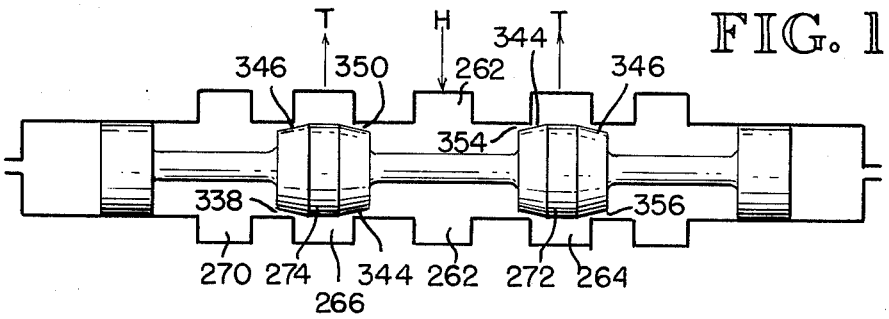

In FIG. 15C, the valve spool 260 is shown as having moved to its center position. In this position, the two restricted passageways 350 and 354, which lead from the high pressure port 262 to the transfer ports 264 and 266 have substantially the same cross sectional area, and the two outwardly positioned restricted passages 356 and 358 also have substantially the same cross sectional area.

In discussing the function of the control valve 238 as it passes through its intermediate position as shown in FIG. 15C, two factors will be considered. First, as was discussed extensively with reference to the operation of the valve 38 of the first embodiment, there is the potential problem of pressure surges in the high pressure working fluid directed from the pump to the control valve. Secondly, there is the problem of potential pressure surges from the fluid in the pressure intensifying apparatus.

To explain this latter problem more fully, with reference back to FIG. 12, when the working piston 242 is traveling to the right, the fluid in the high pressure chamber 252 then begin pressurized (i.e. usually water) is subjected to pressures in the order of 50,000 to 100,000 pounds per square inch. Under such pressures, the water is compressed by as much as ten percent of its volume at atmospheric pressure. Consequently, when the working piston 242 reaches its end limit of travel and the control valve 238 shifts to its opposite position to relieve pressure in the working chamber 250, there is a tendency for the water in the high pressure chamber 252 to expand against its associated piston 244 and transmit a pressure pulse or shock wave back to the fluid in the chamber 250.

To go on with the description of the second embodiment, the problem with respect to potential pressure surges in the fluid from the high pressure pump will now be discussed. With the valve in the position of FIG. 15C, because of the pressure drop across the two passages 350 and 354, the pressure levels in the two transfer ports 266 and 264 are correspondingly reduced. There is also a pressure drop from each of the ports 264 and 266 through the restricted passageways 356 and 358, respectively, to the low pressure ports 268 and 270, respectively. In this intermediate position, the total pressure across each set of passageways (the right set being passageways 354 and 356, and the left set being passageways 350 and 358) is such as not to substantially exceed the back pressure from the discharge nozzle 22 along with the back pressure generated from losses in the system. As in the first embodiment, this alleviates what would otherwise be a pressure surge in the fluid being transmitted from the pump to the intensifier. However, since in this second embodiment of the pressure drop from the high pressure port 262 to the low pressure port 268 and 270 is distributed across two sets of two passageways in series, the cross sectional areas of each of the passageways 350, 354, 356 and 358 are normally made somewhat larger than in the first embodiment, where the pressure drop is accomplished across two single passageways not in series.

To discuss the sizing of the passageways 350, 354, 356 and 358 in more detail, the horsepower of the pump supplying fluid to the apparatus and the sizing of the component parts of the apparatus are such as to operate at a certain maximum power output and within a certain range of pressure of the output fluid. To select the proper size of the passageways 350, 354, 356, and 358, one first considers the operating conditions of the apparatus at maximum power output where the flow through the nozzle is greatest and the potential pressure shocks in the system are most severe. It is for this operating condition that the sizing of the passageways 350, 354, 356 and 358 is selected so that the back pressure exerted thereby matches, or at most does not substantially exceed, the back pressure exerted back through the system by the discharge nozzle resisting flow of liquid therethrough.

However, when lower power applications are required, for example, in the situation where a liquid jet of smaller diameter and consequently smaller volume of flow is used, the energy of the flow of the working fluid in the system is substantially reduced. For example, let it be assumed that the system is designed to pressurize output fluid to 50,000 psi and discharge this output fluid through a nozzle having an effective cross sectional area of six thousandths of an inch at maximum power output. If the nozzle is changed to half that diameter (i.e. three thousandths of an inch), for the same operating pressure the volume of flow is reduced by a factor of four. With regard to the working fluid, its flow rate also is decreased by a factor of four. However, since the kinetic energy in a moving mass of liquid is proportional to the square of the velocity, the kinetic energy in the working fluid, with the three thousandth inch nozzle being used, is one sixteenth the kinetic energy in the working fluid with the six thousandth inch nozzle being used.

Thus, when the control valve moves through its intermediate position, with the passageways 350, 354, 356 and 358 being sized initially for higher flow rates, when the lower flow rates associated with using the smaller nozzle occur, there will be a temporary pressure drop in the working fluid during shifting of the control valve. However, with the energy in the working fluid being substantially less and with the pressure deviation being a drop rather than a spike, the effect of such pressure deviations are not detrimental to the operation of the apparatus. This same principle of sizing the control valve by-pass passageways applies also to the apparatus of the first embodiment described herein.

With respect to the second problem mentioned above (i.e. potential pressure surges in the pressure intensifying apparatus), with the spool 260 in the position shown in FIG. 15A, the left transfer port 266 is directing the working fluid from the pump at full pressure to the left working chamber 250. When the spool has moved from the position of FIG. 15A and is passing from the position shown in FIG. 15B, through the position of FIG. 15C to the position of FIG. 15D, the passage 358 is increasing in cross sectional area, so that the resistance to fluid flow through the passage 258 is decreasing proportionately. Thus the pressure in the then pressurized working chamber 250 decreases at a rate having a functional relationship with the decrease in resistance across the widening passageway 358. Thus, the potential pressure surge caused by the action of the pressurized output fluid in the high pressure chamber 252 is alleviated by this controlled reduction of pressure in the working chamber 250 through the passageway 358.

Figure 15D:
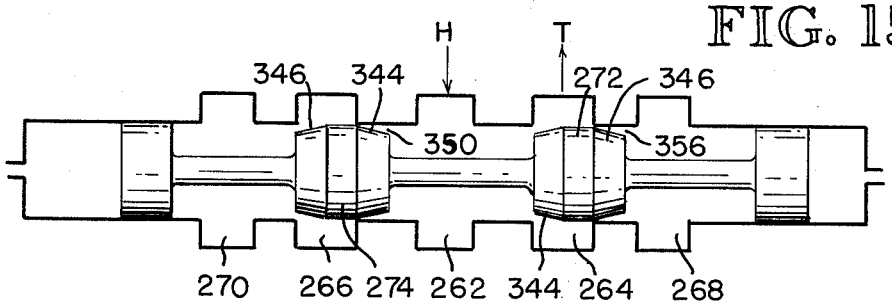
Figure 15E:
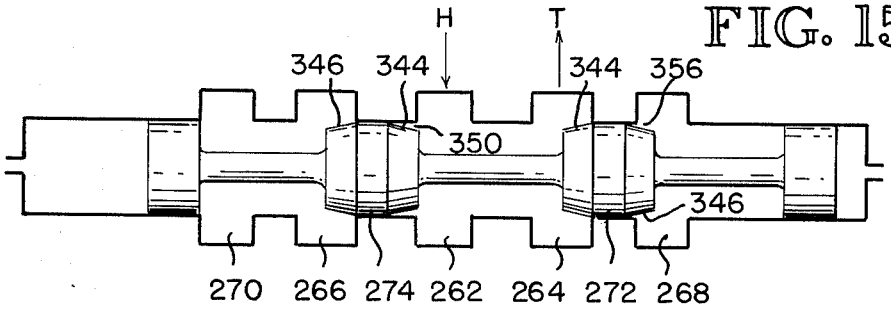

As the spool element 260 moves from the position of FIG. 15D to the position of FIG. 15E, the left transfer port 266 becomes fully open to the left low pressure port 270 so that the fluid pressure in the left working chamber 250 drops essentially to the pressure in the low pressure fluid return line. The high pressure port 262 is fully open to the right transfer port 264 to pressurize the right working chamber 248 and cause the piston 242 to move to the left (as seen in FIG. 12). When the working piston 242 reaches its left end limit of travel, it engages the left shift actuating mechanism 320 to move the shifting valve 286 to itsf opposite position and thus move the spool element 260 back to its left hand positon. In moving back to its left hand position, substantially the same operating sequence occurs as described above with reference to FIGS. 15A through 15E, but in the reverse.

As in the first embodiment, the high pressure output from the pressure intensifier 216 of the present embodiment is directed through the nozzle 22 by means of an arrangement of check valves. Since this system of check valves is substantially the same as in the first embodiment, these check valves will be given numerical designations the same as corresponding valves of the first embodiment, with an *a* suffix distinguishing those of the second embodiment. Thus, there are two intake check valves 109*a* and 118*a* which alternately permit output fluid, such as water, to be drawn into, respectively, high pressure chambers 254 and 252. Another set of check valves 116*a* and 180*a* prevent flow of high pressure fluid back into the high pressure chamber 254 or 252.

In the second embodiment, an accumulator, shown schematically at 360, is connected to the high pressure output line 362 leading to the nozzle 22. This accumulator 360 is simply a high pressure vessel to contain a quantity of the output fluid. Because the output fluid (i.e. water) is compressed by approximately ten percent under the high pressures employed the compressibility of the water itself provides the motive force to supply water back to the high pressure line 252 during that brief time interval when shifting of the apparatus occurs.

It is to be understood that in the actual working embodiment of the present invention, the entire shifting sequence described above normally occurs in a relatively short period of time (in the order of about one-fiftieth of a second). Quite likely there are a number of factors relating to the dynamics of the system (e.g. the momentum of the physical components and also the fluid moving through the system, compression of the fluid, expansion or compression of some of the physical components, etc.) which affect the operation of the invention. Also, various factors such as the size of the accumulator 360 and nozzle 22 will affect the optimum configuration of the control 238. Thus, it can be appreciated that the above described operation of the shifting mechanism of the apparatus of the present invention cannot be considered as an exhaustive explanation, and that there are other factors which have some influence. However, regardless of the accuracy and/or completeness of the above explanation, it has been found that the apparatus of the present invention is an effective high pressure fluid device, and does successfully alleviate to a significant degree undesired pressure surges which would otherwise be present in such a system.

What is claimed is:

1. A fluid pressure intensifying apparatus to provide a flow of a high pressure steam of an output fluid through a discharge nozzle, said apparatus comprising:

a. a working cylinder, b. a working piston mounted in said working cylinder and separating said working cylinder into first and second working chambers, said working piston mounted in said cylinder for reciprocating motion in response to pressurized working fluid being directed alternately into said first and second working chambers, c. high pressure output piston means operatively connected to said working piston so as to be moved along a reciprocating path thereby to deliver a high pressure flow of said output fluid, d. a discharge nozzle to receive said high pressure flow from said output piston means, said discharge nozzle having an effective cross sectional flow area, with said discharge nozzle exerting a back pressure on said working fluid in said working chambers, e. a control valve to direct pressurized working fluid from a working fluid source alternately to said first and second working chambers to cause the reciprocation of said working piston, said control valve comprising a valve element movable to:

1. a first position in which pressurized working fluid is directed to said first working chamber,
2. a second position in which pressurized working fluid is directed to said second working chamber,
3. an intermediate position through which said valve element passes in moving alternately between said first and second positions, said valve in said intermediate position having pressure reducing flow passage means to direct the pressurized working fluid from the working fluid source through said pressure reducing flow passage means, said pressure reducing flow passage means having an effective cross sectional area with a proportional relationship to the effective cross sectional flow area of the discharge nozzle and to the area of the working piston and the area of the high pressure piston, to produce a second back pressure of a value not substantially exceeding the back pressure resulting from transmission of power by said high pressure output piston means through said nozzle, whereby potential pressure surges in said working fluid are alleviated in a manner that when flow of working fluid is increased or decreased to cause a corresponding increase or decrease of flow of said high pressure output fluid, the back pressure at both said pressure redicing flow passage and said nozzle increase or decrease correspondingly to alleviate potential pressure surges back in the working fluid.

2. The apparatus as recited in claim 1, wherein the proportional relationship of the effective cross sectional area of the discharge nozzle to the effective area of said pressure reducing flow passage means is not substantially greater than a value defined in accordance with the following formula:

$$C_v A_v = \frac{C_n A_n A_w}{A_p}\left(\sqrt{\frac{A_w}{A_p}}\right)\sqrt{\frac{D_w}{D_o}}$$

where:

$A_w$ = the effective pressure area of the working piston $A_p$ = the effective pressure area of the high pressure piston $A_n$ = the effective cross sectional flow area of the discharge nozzle $A_v$ = the effective flow area of the pressure reducing flow passage
$C_n$ = orifice discharge coefficient of the discharge nozzle
$C_v$ = orifice discharge coefficient of the pressure reducing flow passage
$D_w$ = the density of the working fluid
$D_o$ = the density of the output fluid.

3. The apparatus as recited in claim 1, wherein said control valve comprises:

a. a first valve component having:
1. a high pressure port means adapted to be connected to said source of high pressure working fluid,
2. a first transfer port means connected to said first working chamber,
3. a second transfer port means connected to said second working chamber,
4. a low pressure port means adapted to be connected to a low pressure area, b. a second valve component movable with respect to said first component and having:
1. a first position in which said high pressure port means is connected to said first transfer port means and said second transfer port means is connected to said low pressure port means,
2. a second position in which said second transfer port means is connected to said high pressure port means and said first transfer port means in connected to said low pressure port means,
3. a third intermediate position where said high pressure port means is connected to said pressure reducing flow passage means to a lower pressure area.

4. The apparatus as recited in claim 3, wherein said first and second valve components are such to define tapered passageway means which functions as said pressure reducing flow passage means.

5. The apparatus as recited in claim 4, wherein there are two tapered passageways formed on opposite sides of said high pressure transfer port means.

6. The apparatus as recited in claim 3, wherein there are two restricted flow passages on opposite sides of said high pressure port means to provide said pressure reducing flow passage means.

7. The apparatus as recited inclaim 1, wherein said control valve is such that with said valve element in its intermediate position, said pressure reducing flow passage means is so arranged that pressurized working fluid from the working chamber then pressurized by the working fluid is directed through said pressure reducing flow passage means so as to provide a controlled reduction of pressure in the then pressurized working chamber, whereby potential pressure surges in said apparatus are alleviated.

8. The apparatus as recited in claim 7, wherein said control valve means comprises:

a. a first valve component having:
1. a high pressure port means adapted to be connected to said source of high pressure working fluid,
2. a first transfer port means connected to said first working chamber,
3. a second transfer port means connected to said second working chamber,
4. a low pressure port means adapted to be connected to a low pressure area, b. a second valve component movable with respect to said first component and having:
1. a first position in which said high pressure port means is connected to said first transfer port means and said second transfer port means is connected to said low pressure port means,
2. a second position in which said second transfer port means is connected to said high pressure port means and said first transfer port means is connected to said low pressure port means,
3. a third intermediate position where said high pressure port means is connected to said pressure reducing flow passage means to a lower pressure and the working chamber then pressurized being connected through its related transfer port means and through said pressure reducing flow passage means to a lower pressure area.

9. The apparatus as recited in claim 8, wherein said first and second valve components are such that with said second valve component in its intermediate position, said first and second valve components define a restricted passageway from the transfer port of the then pressurized working chamber to said low pressure port means.

10. The apparatus as recited in claim 9, wherein said first and second valve components are such as to define a tapered passageway between the transfer port means of the then pressurized working chamber and the low pressure port means.

11. The apparatus as recited in claim 8, wherein with said second valve component in its intermediate position, restricted passageways are formed between said high pressure port means and said first and second transfer port means and restricted passageways are also formed between said first and second transfer port means and said low pressure transfer port means.

12. The apparatus as recited in claim 11, wherein at least one set of the restricted passageways recited in claim 11 comprises tapered passageways.

13. A fluid pressure intensifying apparatus to provide a flow of a high pressure stream of an output fluid through a discharge nozzle, said output apparatus comprising:

a. a working cylinder,
b. a working piston mounted in said working cylinder and separating said working cylinder into first and second working chambers, said working piston mounted in said cylinder for reciprocating motion in response to pressurized working fluid being directed alternately into said first and second working chambers,
c. high pressure output piston means operatively connected to said working piston so as to be moved along a reciprocating path thereby to deliver a high pressure flow of said output fluid,
d. a discharge nozzle to receive said high pressure flow from said output piston means, to provide said stream of output fluid and to cause a back pressure on said working fluid in said working chambers,
e. a control valve to direct pressurized working fluid from a working fluid source alternately to said first and second working chambers to cause the reciprocation of said working piston, said control valve comprising a valve element movable to:
1. a first position in which pressurized working fluid is directed to said first working chamber,
2. a second position in which pressurized working fluid is directed to said second working chamber, 3. an intermediate positon through which said valve element passes in moving alternately between said first and second positions, said valve in said intermediate position providing a pressure reducing flow passage means to direct the pressurized working fluid from the working chamber then pressurized by the working fluid through said pressure reducing flow passage means so as to provide a controlled reduction or pressure in the then pressurized working chamber, whereby potential pressure shocks in the apparatus are alleviated, said apparatus being further characterized in that the control valve comprises:

a. a first valve component having:
   1. a high pressure port means adapted to be connected to said source of high pressure working fluid,
   2. a first transfer port means connected to said first working chamber,
   3. a second transfer port means connected to said second working chamber,
   4. a low pressure port means adapted to be connected to a low pressure area, b. a second valve component movable with respect to said first component and having:
   1. a first position in which said high pressure port means is connected to said first transfer port means and said second transfer port means is connected to said low pressure port means,
   2. a second position in which said second transfer port means is connected to said high pressure port means and said first transfer port means is connected to said low pressure port means,
   3. a third intermediate position wherein the working chamber then pressurized is connected through said pressure reducing flow passage means to said low pressure area, and c. said first and second valve components being so arranged that as said second valve component moves through its intermediate position, said restricted passageway from the then pressurized working chamber increases in cross sectional area so as to provide decreasing impedance to flow therethrough.

14. The apparatus as recited in claim 13, wherein said pressure reducing flow passage means comprises a tapered passageway leading from its related transfer port means to said low pressure area.

15. In a fluid pressure intensifying apparatus which comprises:

a. a working cylinder, b. a working piston mounted in said working cylinder and separating said working cylinder into first and second working chambers, said working piston mounted in said cylinder for reciprocating motion in response to pressurized working fluid being directed alternately into said first and second working chambers, c. high pressure output piston means operatively connected to said working piston so as to be moved along a reciprocating path thereby to deliver a high pressure flow of output fluid, d. a discharge nozzle to receive said high pressure flow from said output piston means to provide a stream of said output fluid, said discharge nozzle having a predetermined cross sectional effective flow area, with the discharge nozzle exerting a back pressure on said working fluid in said working chambers, e. a control valve to direct pressurized working fluid from a working fluid source alternately to said first and second working chambers to cause a reciprocation of said working piston, said control valve comprising a valve element movable to:
   1. a first position in which pressurized working fluid is directed to said first working chamber,
   2. a second position in which pressurized working fluid is directed to said second working chamber, and
   3. an intermediate position through which said valve element passes in moving alternately between said first and second positions, the invention comprising a method to alleviate potential pressure surges, and method comprising:

directing pressurized working fluid, while said valve element is passing through its intermediate position, through pressure reducing flow passage means having a cross sectional area having a proportional relationship to the effective cross sectional flow area of the discharge nozzle to produce a back pressure not substantially exceeding the back pressure resulting from transmission of power from said nozzle, with the result that when flow of working fluid is increased or decreased to cause a corresponding increase or decrease of flow of said high pressure output fluid, the back pressure of both said pressure reducing flow passage and said nozzle increase or decrease correspondingly to alleviate potential pressure surges in the working fluid.

16. The method as recited in claim 15, further characterized in directing said working fluid, when said valve element is in its intermediate position, through a pressure reducing flow passage where the proportional relationship to the effective cross sectional area of the nozzle to the effective area of pressure reducing flow passage is not substantially greater than a value defined in accordance with the following formula:

$$C_v A_v = \frac{C_n A_n A_w}{A_p}\left(\sqrt{\frac{A_w}{A_p}}\right)\sqrt{\frac{D_w}{D_o}}$$

$A_w$ = the effective pressure area of the working piston $A_p$ = the effective pressure area of the big pressure piston $A_n$ = the effective cross sectional flow area of the discharge nozzle $A_v$ = the effective flow area of the pressure reducing flow passage $C_n$ = orifice discharge coefficient of the discharge nozzle $C_v$ = orifice discharge coefficient of the pressure reducing flow passage $D_w$ = the density of the working fluid $D_o$ = the density of the output fluid.

* * * * *

UNITED STATES PATENT AND TRADEMARK OFFICE

CERTIFICATE OF CORRECTION

PATENT NO. : 4,029,440

DATED : June 14, 1977

INVENTOR(S) : John H. Olsen

It is certified that error appears in the above-identified patent and that said Letters Patent are hereby corrected as shown below:

In column 2, line 35, add quotation marks before and after the words "snap action".

In column 9, line 60, "point" should be --pointed--.

In column 9, line 64, "time" should be --times--.

In column 10, line 64, there should be a space between the italicized "a" and the word "suffix".

In column 12, line 21, after the words "positioned outside of" delete the words --the outside of-- (appears twice).

In column 12, line 30, the numeral "156" should be --256--.

In column 12, line 64, after the word "spool" insert the numeral --292--.

In column 13, line 38, the numeral "230" should be --330--.

In column 13, line 48, the numeral "228" should be --288--.

In column 13, line 59, before the numeral "32", insert the numeral --3-- (so that it reads "332").

In column 14, line 18, the word "an" should be --as--.

In column 14, line 36, the word "pistom" should be --piston--.

In column 14, line 50, after the words "pressurize the left", delete the words --and pressurize the left-- (appears twice).

In column 15, line 24, the word "begin" should be --being--.

In column 15, line 36, after the words "of the" insert the words --operation of the--.

In column 15, line 46, after the word "pressure" insert the word --drops--.

In column 17, line 8, the word "itsf" should be --its--.

In column 17, line 21, the letter a should be in quotation marks as --"a"--.

In column 17, line 26, the numeral "180a" should be --108a--.

In column 17, line 52, after the word "control" insert the word --valve--.

In column 19, line 47, there should be a space between the words "in" and "claim".

UNITED STATES PATENT AND TRADEMARK OFFICE

CERTIFICATE OF CORRECTION

PATENT NO. : 4,029,440

DATED : June 14, 1977

INVENTOR(S) : John H. Olsen

It is certified that error appears in the above-identified patent and that said Letters Patent are hereby corrected as shown below:

In column 22, line 50, insert the word "where:" after the mathematical equation and on the line above the explanation of the symbols in a mathematical equation.

In column 22, line 53, the word "big" should be --high--.

Signed and Sealed this

*Fourteenth* Day of *March 1978*

[SEAL]

*Attest:*

RUTH C. MASON
*Attesting Officer*

LUTRELLE F. PARKER
*Acting Commissioner of Patents and Trademarks*